United States Patent [19]

Shibahara et al.

[11] 4,346,575

[45] Aug. 31, 1982

[54] METHOD OF WIDTH CONTROL IN HOT STRIP MILL

[75] Inventors: Takashi Shibahara, Osaka; Teruo Kohno, Nishinomiya; Yoshisuke Misaka, Takarazuka, all of Japan

[73] Assignee: Sumitomo Metal Industries, Ltd., Osaka, Japan

[21] Appl. No.: 253,630

[22] PCT Filed: Oct. 19, 1979

[86] PCT No.: PCT/JP79/00264

§ 371 Date: Sep. 8, 1980

§ 102(e) Date: Sep. 8, 1980

[87] PCT Pub. No.: WO81/01114

PCT Pub. Date: Apr. 30, 1981

[51] Int. Cl.[3] ..... B21B 13/16; B21B 37/12; B21B 37/10

[52] U.S. Cl. ..... 72/16; 72/234

[58] Field of Search ..... 72/16, 67, 10–13, 72/226, 234

[56] References Cited

U.S. PATENT DOCUMENTS

| | | | |
|---|---|---|---|
| 3,543,548 | 12/1970 | Smith, Jr. | 72/7 |
| 4,063,076 | 12/1977 | Morooka et al. | 72/13 |

FOREIGN PATENT DOCUMENTS

| | | | |
|---|---|---|---|
| 50-24261 | 8/1975 | Japan | 72/16 |
| 50-24907 | 8/1975 | Japan . | |
| 51-87455 | 7/1976 | Japan . | |
| 51-25823 | 8/1976 | Japan . | |
| 52-26503 | 7/1977 | Japan | 72/13 |

*Primary Examiner*—Lowell A. Larson

*Attorney, Agent, or Firm*—Wenderoth, Lind & Ponack

[57] ABSTRACT

A method for controlling the width of material in hot strip rolling through a train of alternately arranged vertical and horizontal roughing roll stands. The method restricts the width variation of the strips at the delivery side of the roughening rolls caused by the difference in temperature distribution in the widthwise direction of the strips between skidded areas and non-skidded areas by controlling the degrees of roll opening of a vertical roll stand based on the measurement of the width of the material to be rolled measured by a width meter, the vertical roll stand being disposed downstream of the measuring point.

1 Claim, 10 Drawing Figures

METHOD OF WIDTH CONTROL IN HOT STRIP MILL

FIELD OF THE INVENTION

The present invention relates to width control of a rolled metal product produced by a hot strip mill and more particularly to a method for reducing or eliminating variation in width resulting from the hot rolling.

BACKGROUND OF THE INVENTION

A hot rolling operation is carried out through a train of roughing rolls in which a plurality of vertical roll stands and a plurality of horizontal roll stands are arranged in series and alternately one after another. It has been the general practice in a rolling operation to set the roll gaps or the degrees of opening of the vertical roll stands at a desired roll opening prior to the feeding of the slab or material into the roll-stands, and such predetermined roll gaps are usually kept unchanged throughout the rolling operation for that material. Due to uneven distribution of temperatures or so-called skid marks in the slabs generated in the furnace, there is inevitably a possibility of variation in width of the rolled product such as strip and the like if such roll gaps are kept unchanged during the rolling operation. Because of this, in order to avoid the possibility of insufficient width in the rolled products, it has been the practice to intentionally add a substantial surplus width which would subsequently be trimmed to get a product having the desired dimensions. This procedure, however, results in substantial waste and reduction in yield.

In an attempt to eliminate or reduce variation in width of the rolled products due to such skid marks in the slab fed from the furnace, there has been proposed and disclosed the method for controlling the widths of materials to be rolled in the Japanese Patent Publication No. 26,503/1977 specification which comprises the steps of measuring temperature changes in a longitudinal direction of a material to be rolled upstream of the vertical roll stands, determining the deviation between a minimum temperature and a temperature at respective points of the rolled material, estimating variation in the material widths from the thus-obtained temperature deviation, determining a schedule for changing the roll gap or degree of opening of the vertical roll stands which is enough to compensate for the estimated variation in the material width, and controlling the roll openings of the vertical roll stands in accordance with the predetermined schedule for changing the roll opening during the rolling operation. This method is premised on the assumption that the cause of the width variation in a material is as follows.

That is, in a hot slab fed from the furnace, there would appear areas of a relatively high temperature and of a relatively low temperature alternately one after another in the longitudinal direction thereof under the effect of heat shielding due to the skid arrangement in the furnace. And, the relatively low temperature areas of the material or slab would have more resistance against the deformation than the relatively high temperature areas, with the result that a greater edging force is required in the relatively low temperature areas. On the other hand, since rigidity of the vertical rolls is relatively small, there would occur an effect of the large or small edging forces for these areas mentioned above, and therefore, it has been believed that the degree of width reduction by the vertical roll stands in the relatively low temperature areas would become smaller than that for the relatively high temperature areas, whereupon such variation might occur in the widths of the rolled bar or products.

The method of controlling the rolled product width according to the Japanese Patent Publication No. 26,503/1977 specification was on the assumption that such width variation would occur from the cause of uneven temperature distribution in the longitudinal direction of a slab to be rolled, and this led to adjusting the roll gap of the vertical rolls in accordance with the temperature variation existing in the longitudinal direction of the slabs or materials.

The well known prior methods of controlling the rolled strip widths along the entire longitudinal areas of the materials to be rolled are those disclosed in the Japanese Patent Publication No. 25,823/1976, the Japanese Patent Laid-Open Application No. 72,350/1977, the Japanese Patent Publication No. 24,907/1975, and the Japanese Patent Laid-Open Application No. 87,455/1976. In the method disclosed in the Japanese Publication No. 25,823/1976, a slab or material is rolled by the vertical rolls in such a manner that the width spread in a material rolled therefrom will merely be relatively increased or decreased in inverse proportion to the width of a material to be rolled.

The method disclosed in the Japanese Patent Laid-Open Application No. 72,350/1977 is directed to the control of roll gap of the vertical rolls and is based on the assumption that the amount of width spread in a material obtained by the vertical rolling operation followed by the horizontal rolling operation is determined as a function of the longitudinal position (distance from the leading end) of the material, which comprises the steps of applying the thus-presumed relationship as a width spread factor to each combination of the thickness and the width of the material, and setting a pattern to be utilized for controlling the opening of the vertical rolls so as to control the above mentioned width spread according to the factor above. The method disclosed in the Japanese Patent Publication No. 24,907/1975 is concerned with the control of the roll gap of the vertical rolls and is premised on the calculation based on the equation relative to the width spread of the material to be rolled which is determined solely in connection with the given rolling conditions, while the method disclosed in the Japanese Patent Laid-Open Application No. 87,455/1976 is also concerned with the provision of the gap control of the vertical rolls in consideration of the state of width spread of the material to be rolled which is likewise defined exclusively under the rolling conditions.

DISCLOSURE OF THE INVENTION

According to the results of intensive study by the inventors of the present invention, it was concluded that the primary cause of the width variation as experienced in the material to be rolled is not any of the assumptions made in the foregoing prior inventions mentioned hereinbefore, but such as is discussed below.

The present inventors carried out a series of field studies over a long period of time based on the actual profiles of rolled materials delivered from the vertical rolls, the extent of width variation of the rolled materials delivered from the horizontal rolls disposed immediately after that vertical rolls, and also upon the temperature distribution in the transverse or widthwise direction of the rolled materials.

It was observed that there were some areas free from any effect of heat shielding produced by the skid arrangement in the furnace (hereinafter referred to as "skid-free areas") and other areas which showed the effect of heat shielding by the skid arrangement (hereinafter referred to as "skidded areas") existing alternately in the longitudinal direction of a slab fed from the furnace as stated hereinbefore, and it was proven that the principal of cause of which width variation in a rolled bar as mentioned hereinbefore is a substantial difference in the cross-sectional shape of the rolled material between the skidded areas and the skid-free areas thereof immediately after a vertical rolling operation.

In summary, the present invention is essentially directed to the provision of an improved method for controlling the width variation of a rolled bar in which a necessary amount of width reduction by a vertical roll stand is calculated from the amount of bulging or elevation in thickness at the lateral margin of a material to be rolled in the widthwise or transverse direction thereof is different between the skidded areas and the skid-free areas of the material, whereupon the roll gap or opening of the vertical roll stand can be controlled properly. For convenience, throughout the description, the term "slab" is used for the raw material to be fed to a train of roughing rolls, the term "material" for the material undergoing the rolling operation and the term "bar" or "rolled bar" for the material delivered out of the train of roughing rolls.

BRIEF DESCRIPTION OF THE DRAWING

FIGS. 1*a*, 1*b* and 1*c* are illustration for showing the cause of a width variation of a rolled bar that is the premise of the present invention; among which FIG. 1*a* is a fragmentary cross-sectional view showing a lateral margin of a material taken at the entry side of a vertical roll stand, FIG. 1*b* is a similar cross-sectional view showing a skidded area in broken line and a skid-free area in solid line in a material at the delivery side of the vertical rolls, and FIG. 1*c* is a similar cross-sectional view showing a skidded area in broken line and a skid-free area in solid line on the same lateral margin of a material immediately after delivered from the horizontal rolls, hatching being omitted from all of the figures for the convenience of drawing:

PREFERRED EMBODIMENT OF THE INVENTION

Figure 1:
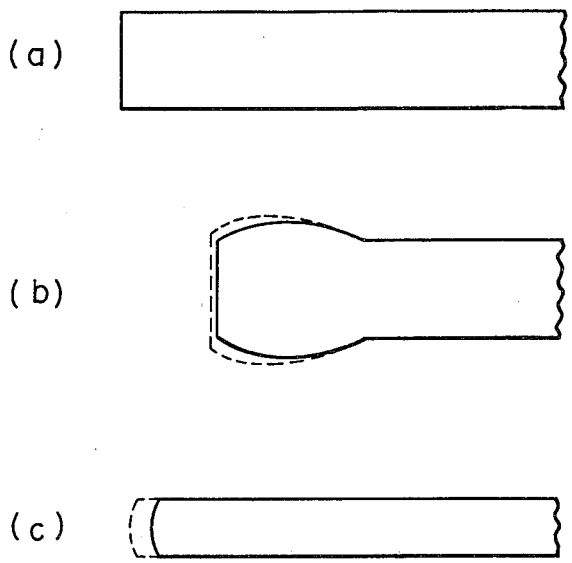
Figure 2:
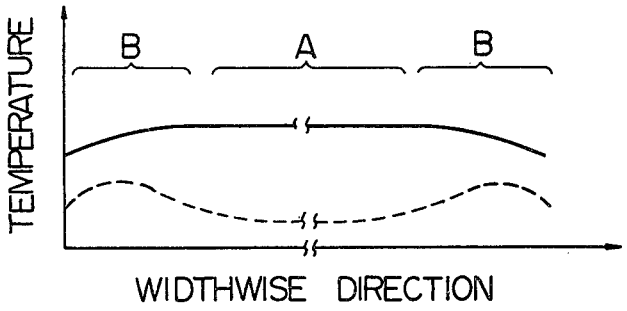
FIG. 2 is a graphic representation showing a state of temperature distribution viewed in the width direction of a material to be rolled for illustration of the cause of width variation that is the premise of the present invention wherein skidded area is shown in broken line and skid-free area in solid line.

Before going on with the embodiment of the present invention, explanation will be given on the results attained from the extensive studies by the present inventors as stated above in conjunction with FIGS. 1 and 2. That is, FIG. 1*a* is presented to show, in cross-section, a lateral margin of a material to be rolled at the entry side of the vertical rolls, FIG. 1*b* showing the same section of the material rolled at the delivery side of the vertical rolls, and FIG. 1*c* showing the same section of the material delivered from the horizontal rolls immediately after the vertical rolls. As best seen in FIG. 1*b*, the lateral margin of the material taken immediately after a vertical rolling operation exhibits a bulging or elevation in thickness of a dog-bone like shape in cross-section, regardless of its being a skidded area shown in broken line or its being skid-free area shown in solid line. However, it is noted that there is a substantial difference in their bulging amounts and configurations; bulging in the skidded area is greater than in the skid-free area, and particularly the bulging becomes significantly greater near the lateral edge of the skidded area. Such difference in extent of bulging and configuration between the skidded area and the skid-free area will result in variation or difference in the material width as typically shown in FIG. 1*c* taken after a horizontal rolling operation in such a manner that the skidded are (shown in broken line) brings a greater width spread than that of the skid-free area (shown in solid line).

The lateral margin of the material having the skidded area is considered to exhibit remarkable bulging immediately after a vertical rolling operation for the following reason. That is, in a typical temperature distribution across the width of a material to be rolled, as shown in FIG. 2, it is considered that the temperature of the middle area (A) across the width of a material is higher than that of the lateral marginal portions (B) thereof in the skid-free area (as shown in solid line), while the temperature of the middle area (A) is lower than that of the lateral marginal portions (B) in the skidded area (shown in broken line). Also, the middle area (A) of the material having the skidded area is not easily extended in the longitudinal direction (the rolling direction) thereof as the degree of restricting effect in this direction is high, and therefore, such bulging would be concentrated at the lateral marginal portions of the material at the time of a vertical rolling operation.

According to this consideration, it is more reasonable to conclude that such variation in a material width while being rolled is due to a substantial difference in temperature distribution across the width of the material between the skidded area and the skid-free area, rather than due to an uneven temperature distribution along the longitudinal direction of the material.

In this connection, it is to be noted, as further discussed mathematically later, that longitudinal variation of such bulging at the lateral marginal portions of the rolled material observed after a vertical rolling step and longitudinal variation of spread in width of the material observed after a horizontal rolling step due to such bulging can be estimated priory based on an extent of width variation of a material to be rolled immediately before the vertical rolling subsequent to the horizontal rolling.

The present invention, the subject matter of which resides in a hot rolling operation by way of train of roughing roll stands, was materialized in accordance with such considerations. The present invention comprises the steps of measuring the width of a material to be rolled over at least the entire middle area thereof out of the entire longitudinal area thereof at the delivery side of any one of horizontal roll stands disposed in the middle of the train of roughing roll stands; determining respective local coefficients of width spread due to bulging at the lateral marginal portions for at least all the middle area out of the entire longitudinal area of the material to be rolled based on the values of the variation in width of the respective portions in the longitudinal direction which are derived from the measurement above, the degree of width reduction at each of the vertical roll stands upstream of the measuring point and a reference coefficient of width spread empirically determined by the rolling conditions; thereafter calculating a desired amount of modification of the opening in the vertical roll stand over at least the entire middle area of the material in order to have the value of width variation at the respective portions reduced substantially to zero at the end of the train of roughing roll stands on the basis of the local coefficient of width spread due to respective bulging determined as above, the amount of width reduction at each of the vertical roll stands where roll gap or opening to be controlled, the reference coefficient of width spread due to bulging, and the values of width variation at the respective portions derived as above; and controlling the roll gap or opening in at least one vertical roll stand disposed downstream of measurement so that the desired amount of modification may be attained over at least the entire middle area out of the entire longitudinal area of the material.

Now, description will be given on the fundamental principle and concept of a method of controlling width in rolled material according to the present invention.

Firstly, let us consider with respect to general variation in width of the material to be passed through a vertical roll stand and a horizontal roll stand in the "i−th" order from the entrance of a train of roughing roll stands.

As stated hereinbefore, in consideration that a skid-free area is a portion which is free from an effect of heat shielding due to the skid arrangement within the furnace, it can be said that the temperature of such skid-free area is generally highest among any other portions of the slab. As a consequence, the width of the rolled material will become narrowest at the portions corresponding to the skid-free areas over the entire middle area extending in the longitudinal direction of the material. The skidded areas are subjected to the effect of the skid arrangement in the furnace, and therefore, are generally low in temperature in comparison with the skid-free areas thereby becoming substantially wide portions in the rolled material or bar.

The term "the amount of width variation" as used herein means a difference in width of the material between the skidded areas and the skid-free areas.

Now, the extent of bulging $\Delta H_i$ of a skid-free area observed at the "i−th" vertical roll stand of the train of roughing roll stands is represented as follows; i.e., $$\Delta H_i = \gamma_1 \cdot \Delta V_i$$

where, $\Delta V_i$ represents the amount of width reduction at a skid-free area rendered by a vertical roll stand, and $\gamma_1$ is a ratio of contribution to a bulging formation at the lateral marginal portions of a material (hereinafter referred merely to as "a bulging") to the amount of width reduction at the skid-free area.

If a ratio of contribution to an amount of width spread to the bulging at the skid-free area mentioned above of the material delivered from a horizontal roll stand immediately following the vertical roll stand is $\gamma_2$, the amount of width spread $\Delta B_i$ contributed from the bulging at the skid-free area of the material observed at the "i−th" horizontal roll stand—that is the one immediately following the "i−th" vertical roll stand, is represented as follows; i.e., $$\Delta B_i = \gamma_2 \cdot \Delta H_i$$

If a product of $\gamma_1$ and $\gamma_2$ is $\gamma$, the above equation may be converted as follows; i.e., $$\Delta B_i = \gamma \cdot \Delta V_i \quad (1)$$

Now, let us call this $\gamma$ value the coefficient of width spread due to the bulging of the skid-free area. Then, the amount of width reduction at the skidded area rendered by the "i−th" vertical roll stand $\Delta V_{Si}$ is represented as follows; i.e., $$\Delta V_{Si} = \Delta V_i + \Delta W_{i-1} - \Delta W_{Ei}$$

where, $\Delta W_{i-1}$ represents a difference in width of the material or an amount of width variation between the above mentioned skidded area and skid-free area at the delivery side of the "i−1 th" horizontal roll stand, and $W_{Ei}$ represent an amount of width variation of the material at the delivery side of the "i−th" vertical roll stand.

Next, amount of width spread $\Delta B_{Si}$ contributed from the bulging at the skidded area of the material at the delivery side of the "i−th" horizontal roll stand may be represented as follows;

$$\Delta B_{Si} = \gamma_S \cdot (\Delta V_i + \Delta W_{i-1} - \Delta W_{Ei}) \quad (2)$$

where, $\gamma_S$ represents a coefficient of width spread due to the bulging at the skidded area. Herein, a sign in connection with the amount of such variation in width as $W_i$ and $W_{Ei}$ is defined to be positive in the case that the width of the material at the skidded area is greater than that of the material at the skid-free area.

With respect to the amount of width spread rendered by a horizontal roll stand, it is of course that it covers an ordinary amount of width spread other than that contributed from the bulging mentioned above. However, as such ordinary amount of width spread is, as generally admitted, dependent on such factors as width and thickness of the material, roll diameters and a rolling reduction, it is considered that the ordinary spread derived from such factors above is substantially equal in both the skidded area and the skid-free area, and consequently, such ordinary width spread does not affect the extent of width variation in question.

As stated hereinbefore, if the amount of width spread $\Delta B_{Si}$ due to the bulging at the skidded area of the material at the delivery side of the "i−th" horizontal roll stand may be represented by the equation (2) above, the amount of width variation $\Delta W_i$ observed at the delivery side of the "i−th" horizontal roll stand is represented by the following equation, i.e., $$\Delta W_i = \Delta B_{Si} - \Delta B_i + \Delta W_{Ei} \quad (3)$$
$$= \gamma_S \cdot (\Delta V_i + \Delta W_{i-1} - \Delta W_{Ei}) - \gamma \cdot \Delta V_i + \Delta W_{Ei}$$

The extent of width variation at the delivery side of the vertical roll stand is usually of a very small value, then:

$$\Delta W_i >> \Delta W_{Ei}$$

$$\Delta W_{i-1} >> \Delta W_{Ei}$$

the above mentioned extent of width variation $\Delta W_i$ may be represented as follows;

$$\Delta W_i = \gamma_S \cdot (\Delta V_i + \Delta W_{i-1}) - \gamma \cdot \Delta V_i \quad (4)$$
$$= (\gamma_S - \gamma) \cdot \Delta V_i + \gamma_S \cdot \Delta W_{i-1}$$

On the other hand, as described hereinbefore, the skid-free area is not affected by the skid, and therefore, the coefficient $\gamma$ of width spread due to the bulging is generally dependent empirically on such rolling conditions, in practice, as material dimensions (width and thickness), the temperature of the furnace, the kind of steel to be rolled, the pass schedule, etc. In contrast, in view of the fact that the skidded area is subject to the effect of the skid arrangement in a furnace, the coefficient $\gamma_S$ of width spread due to bulging at such affected areas may vary with the influence of such skid arrangement upon such areas. In this respect, if the coefficient of width spread due to bulging at the skid-free area is referred to as "reference coefficient of width spread due to bulging", and if the coefficient of width spread due to bulging at the respective skidded areas is called as "local coefficient of width spread due to respective bulging", the local coefficient $\gamma_S$ of width spread due to respective bulging may be obtained from a calculation. For instance, in the case a rolling reduction is modified at the "m−th" vertical roll stand by way of controlling a roll gap, the local coefficient $\gamma_s$ of width spread due to respective bulging mentioned above is led from the calculation as follows.

That is, the amount of width variation $\Delta W_{m-1}$ of the material at the delivery side of the "m−1 th" horizontal roll stand upstream of the abovementioned "m−th" vertical roll stand may be obtained from repeated application of the equation (4) above, as follows; i.e., $$\Delta W_{m-1} = (\gamma_S - \gamma)\Delta V_{m-1} + \gamma_S \cdot \Delta W_{m-2} \quad (5)$$
$$= (\gamma_S - \gamma)\Delta V_{m-1} + \gamma_S(\gamma_S - \gamma)\Delta V_{m-2} + \gamma_S^2 \cdot \Delta W_{m-3}$$

-continued $$= (\gamma_S - \gamma)\Delta V_{m-1} + \gamma_S(\gamma_S - \gamma)\Delta V_{m-2} + \ldots + \gamma_S^{m-2}(\gamma_S - \gamma)\Delta V_1 + \gamma_S^{m-1} \cdot \Delta W_o$$

where, $\Delta W_o$ is the amount of width variation of the material before rolled (i.e., the slab), and therefore, $\Delta W_o \cong 0$, and then, the equation (5) above is now converted as follows; i.e., $$\Delta W_{m-1} \cong (\gamma_S - \gamma) \cdot (\Delta V_{m-1} + \gamma_S \cdot \Delta V_{m-2} + + \ldots \gamma_S m-2 \cdot \Delta V_1) \quad (6)$$

Now, each of the amounts of width reduction $\Delta V_{m-1}$, $\Delta V_{m-2}$, $\Delta V_1$ and the reference coefficient $\gamma$ of width spread due to bulging are values empirically dependent on the rolling condition. On the other hand, the amount of width variation $\Delta W_{m-1}$ of the material at the delivery side of the "m−1 th" horizontal roll stand is obtained from a field measurement, and consequently, the local coefficient $\gamma_S$ of width spread due to respective bulging can be derived from well known repeated calculation on the basis of the equation (6) above.

Next, in the case that a rolling reduction is modified so that the amount of width reduction at the skidded area may increase by $\Delta v_m$ from the amount of width reduction $\Delta V_m$ at the skid-free area in the "m−th" vertical roll stand, the amount of width variation $\Delta W_m$ of the material at the delivery side of the "m−th" horizontal roll stand, i.e., the one immediately after the above mentioned vertical roll stand may be represented by the following equation by way of substituting $\Delta V_m$ for $\Delta V_i$, $\Delta W_{m-1}$ for $\Delta W_{i-1}$, and $\Delta v_m$ for $\Delta W_{Ei}$ in the equation (3) above; i.e., $$\Delta W_m = (\gamma_S - \gamma)\Delta V_m + \gamma_S \cdot \Delta W_{m-1} - (1 - \gamma_S)\Delta V_m \quad (7)$$

On the other hand, the amount of width variation $\Delta W_n$ of the material at the delivery side of the "n−th" horizontal roll stand, i.e., the last one of the train of roughing roll stands may be represented by way of repeated application of the equation (4) above till the "m−th" one as follows; i.e., $$\Delta W_n = (\gamma_S - \gamma) \cdot (\Delta V_n + \gamma_S \cdot \Delta V_{n-1} + \ldots + \gamma_S n-m-1 .\ \Delta V_{m+1}) + \gamma_S n-m \cdot \Delta W_m \quad (8)$$

Therefore, substituting the value $\Delta W_m$ in the equation (7) above into the equation (8) above, the amount of width variation $\Delta W_n$ of the material at the delivery side of the train of roughing roll stands with the rolling reduction being modified at the "m−th" vertical roll stand as mentioned above is now represented by the following equation; i.e., $$\Delta W_n = (\gamma_S - \gamma) \cdot (\Delta V_n + \gamma_S \cdot \Delta V_{n-1} + \ldots + \gamma_S^{n-m-1} \cdot \Delta V_{m+1}) + \gamma_S^{n-m}\{(\gamma_S - \gamma)\Delta V_m + \gamma_S \cdot \Delta W_{m-1} - (1 - \gamma_S)\Delta V_m\} \quad (9)$$
$$= (\gamma_S - \gamma)(\Delta V_n + \gamma_S \cdot \Delta V_{n-1} + \ldots + \gamma_S^{n-m} \cdot \Delta V_m) + \gamma_S^{n-m+1} \cdot \Delta W_{m-1} - \gamma_S^{n-m}(1 - \gamma_S)\Delta V_m$$

With such arrangement, $\Delta v_m$ the amount of width reduction to be increased, i.e., the amount of modified width at the "m−th" vertical roll stand which may reduce the amount of width variation $\Delta W_n$ at the delivery side of the train of roughing roll stands to zero is then represented as follows; i.e., $$\Delta V_m = \frac{1}{\gamma_S{}^{n-m}(1-\gamma_S)}\{(\gamma_S-\gamma)\cdot(\Delta V_n + \gamma_S\cdot\Delta V_{n-1}+\ldots+\gamma_S{}^{n-m}\cdot\Delta V_m)+\gamma_S{}^{n-m+1}\cdot\Delta W_{m-1}\} \quad (10)$$

In consideration that in the equation (10) above, each of the amounts of width reduction $\Delta V_n$, $\Delta V_{n-1}$, . . . $\Delta V_m$, at each of the "n, n−1, . . . , m−th" vertical roll stands, respectively, and the reference coefficient $\gamma$ of width spread due to bulging of the material are ones empirically dependent on the rolling conditions to be set, and on the other hand that the amount of width variation $\Delta W_{m-1}$ of the material at the "m−1 th" horizontal roll stand may be obtained from a field measurement, and if so obtained, the local coefficient $\gamma_S$ of width spread due to respective bulgings may be derived from the equation (6) above. As a consequence, by obtaining the amount of width variation of the material to be rolled on the basis of the measured value of width thereof at the delivery side of the horizontal roll stand, it is practicably possible to obtain an appropriate amount of modified rolling reduction that would reduce to zero the amount of width variation of the material at the end of the entire train of roughing roll stands.

Now, in this connection, it is noted that if the "m−th" vertical roll stand is adjusted with its roll gap so that the amount of width reduction of the material at its skidded area may be increased by the very value of $\Delta v_m$ as represented in the equation (10) above from that at the skid-free area thereof, the amount of width variation $\Delta W_n$ is made zero at the end of the train of roughing roll stands as mentioned above.

In this case, the value $\Delta v_m{}^*$ to be applied for screwdown—that is, the desired amount of roll gap change for the skidded area of the material—is obtained from the following equation; i.e., $$\Delta V_m{}^* = \frac{K+Q}{K}(\Delta V_m + \Delta W_{Em})$$

where, Q represents a gradient of the plastic deformation curve, and K represents a rigidity coefficient of the "m−th" vertical roll stand. Also, $\Delta W_{Em}$ represents the amount of width variation for the case that the "m−th" vertical roll stand is not modified with its rolling reduction, and usually, $\Delta v_m >> \Delta W_{Em}$, so the above equation is now led as follows; i.e., $$\Delta V_m{}^* = \frac{K+Q}{K}\cdot\Delta V_m \quad (11)$$

In consideration that Q is known from the rolling conditions, while K is a value derived from the particular vertical roll stand, the desired amount of modified rolling reduction may be derived from the equation (11) above.

While what has been stated heretofore is particularly applicable to the case when measurement of material width is conducted at the delivery side of the "m−1 th" horizontal roll stand from the train of roughing roll stands, and the control of the roll gap is practiced at the next or "m−th" vertical roll stand, it is to be noted that it is not essential for the present invention to effect that control of roll gap at the vertical roll stand immediately after the width measurement, but such control may be practiced at any one of the vertical roll stands of the "m−1 th" order or stands subsequent thereto. In other words, if width measurement is conducted at, for instance, the "m−1 th" horizontal roll stand and then a roll gap control is practiced at the "m+1 th" vertical roll stand, respectively, and then likewise by way of substitution in the equation (3) above of the value of $\Delta W_{m+1}$ for $\Delta V_i$, $\Delta W_m$ for $\Delta W_{i-1}$, and $\Delta v_{m+1}$ for $\Delta W_{Ei}$, respectively, the amount of width variation $\Delta W_{m+1}$ may be represented in the equation (12) as follows; i.e., $$\Delta W_{m+1}=(\gamma_S-\gamma)\Delta V_{m+1}+\gamma_S\cdot\Delta W_m-(1-\gamma_S)\Delta v_{m+1} \quad (12)$$

More particularly, by using the equation (4) above, when the value $\Delta W_m$ is represented by way of $\Delta W_{m-1}$, $\Delta V_m$, etc., the equation (12) above may be converted to the equation (13) below.

$$\Delta W_{m+1} = (\gamma_S-\gamma)\Delta V_{m+1}+\gamma_S(\gamma_S-\gamma)\Delta V_m+\gamma_S{}^2\cdot\Delta W_{m-1}-(1-\gamma_S)\Delta v_{m+1} = (\gamma_S-\gamma)(\Delta V_{m+1}+\gamma_S\cdot\Delta V_m)+\gamma_S{}^2\cdot\Delta W_{m-1}-(1-\gamma_S)\Delta v_{m+1} \quad (13)$$

On the other hand, by way of repeated application of the equation (4) above with up to the "m+1 th" one, the amount of width variation $\Delta W_n$ of the material at the delivery side of the last one of the train of roughing roll stands, i.e., the "n−th" horizontal roll stand may be represented as follows; i.e., $$\Delta W_n=(\gamma_S-\gamma)\cdot(\Delta V_n+\gamma_S\cdot\Delta V_{n-1}+\ldots+\gamma_S{}^{n-m-2}\cdot\Delta V_{m+2})+\gamma_S{}^{n-m-1}\cdot\Delta W_{m+1} \quad (14)$$

Therefore, by introducing the equation (13) above to the term $\Delta W_{m+1}$, the equation (14) may then be as follows; i.e., $$\Delta W_n=(\gamma_S-\gamma)\cdot(\Delta V_n+\gamma_S\cdot\Delta V_{n-1}+\ldots+\gamma_S{}^{n-m-2}\times\Delta V_{m+2}+\gamma_S{}^{n-m-1}\cdot\Delta V_{m+1}+\gamma_S{}^{n-m}\cdot\Delta V_m)+\gamma_S{}^{n-m+1}\cdot\Delta W_{m-1}-\gamma_S{}^{N-M-1}\cdot(1-\gamma_S)\Delta v_{m+1} \quad (15)$$

With such arrangement, the amount of width reduction to be increased at the "m+1 th" vertical roll stand that may reduce to zero the amount of width variation $\Delta W_n$ at the end of the overall train of roughing roll stands as expressed by the equation (15) above is now represented as follows; i.e., $$\Delta v_{m+1} = \frac{1}{\gamma_S{}^{n-m-1}\cdot(1-\gamma_S)}\{(\gamma_S-\gamma)\cdot(\Delta V_n+\gamma_S)\times\Delta V_{n-1}+\ldots+\gamma_S{}^{n-m}\cdot\Delta V_m)\times\gamma_S{}^{n-m+1}\cdot\Delta W_{m-1}\} \quad (16)$$

As a consequence, it is noted that by applying the equation (16), the amount of width reduction to be increased $\Delta v_{m+1}$ may now be derived at the "m−1 th" vertical roll stand that reduces to zero the amount of width variation at the end of the entire train of roughing rolls.

While the foregoing is the description on the case that the extent of modified rolling reduction is to be performed at a single vertical roll stand in the train of rolls, it is to be noted that such modification may alternatively be practiced at a plurality, such as two, of vertical roll stands in the train.

For example, in the case that owing to such limit conditions as a small output of a screwdown motor at a vertical roll stand or others, it is not feasible to obtain a desired amount of rolling width reduction enough to reduce to zero the amount of width variation at the end of the overall train of roughing rolls only with the "m−th" vertical roll stand, it would be necessary that a next, i.e., the "m+1 th" vertical roll stand, be further modified with its amount of rolling width reduction. In such a case, if the amount of width reduction to be increased for modification in the amount of width reduction at the "m−th" vertical roll stand is $\Delta v'_m$, the amount of width variation $\Delta W'_m$ to be feasible at the delivery side of the "m−th" horizontal roll stand is represented as follows in a way similar to equation (7) above, $$\Delta W_m' = (\gamma_S - \gamma)\Delta V_m + \gamma_S \cdot \Delta W_{m-1} - (1-\gamma_S)\Delta v_m, \quad (17)$$

Then, the amount of increased width reduction $\Delta v_{m+1}$ available at the "m+1 th" vertical roll stand that may reduce to zero the amount of width variation at the end of the train of roughing rolls is now obtained as follows, being led by transformation from the equation (10) above, i.e., $$\Delta v_{m+1} = \frac{1}{\gamma_S^{n-m-1}(1-\gamma_S)}\{(\gamma_S - \gamma)\cdot(\Delta V_n + \gamma_S \cdot \Delta V_{n-1} + \ldots + \gamma_S^{n-m-1}\cdot\Delta V_{m+1}) + \gamma_S^{n-m}\cdot\Delta W_m$$

And, by substituting the value $\Delta W'_m$ given from the equation (17) above for the term $\Delta W_m$:

$$\Delta v_{m+1} = \frac{1}{\gamma_S^{n-m-1}(1-\gamma_S)}[(\gamma_S - \gamma)\cdot(\Delta V_n + \gamma_S \cdot \Delta V_{n-1} + \ldots + \gamma_S^{n-m-1}\cdot\Delta V_{m+1}) + \gamma_S^{n-m}\{(\gamma_S - \gamma)\Delta V_m + \gamma_S \cdot \Delta W_{m-1} - (1-\gamma_S)\Delta v'_m\}] \quad (18)$$

In the equation (18) above, it is noted that the amount of width reduction $\Delta V_n$, $\Delta V_{n-1}$, . . . $\Delta V_m'$, and the reference coefficient $\gamma$ of width spread due to bulging are empirically dependent on the rolling conditions to be set, and that the amount of width variation $\Delta W$ at the delivery side of the "m−1 th" horizontal roll stand may be attained from a field measurement, and once this measurement value is obtained, the local coefficient $\gamma_S$ of width spread due to bulging in this case may also be derived from the equation (6) above. On the other hand, as the amount of increased width reduction $\Delta v_m'$ is given initially as a predetermined value for the "m−th" vertical roll stand, by introducing such value above into the equation (18), it is possible to obtain the amount of width reduction to be increased $\Delta v_{m+1}$ for modification of the opening at the "m+1 th" vertical roll stand and to finally attain the desired state wherein the width variation in the rolled bar is substantially zero.

As explained above, it has been found that the necessary modification value to be applied in the opening of the vertical roll stand can be obtained for each of the portions, the skidded areas, of the material where the variation in width is expected. Accordingly, it will be foreseen that the width variation in the longitudinal direction of the rolled bar may be reduced substantially to zero by performing the calculation above for each of the portions of the material where such variation is to be expected.

When such slab is fed into a train of roughing rolls, width variation may be observed in practice, even within and/or between the skid-free portions in the same material. Therefore, in practicing the present invention, the width of the skid-free portions is measured at the intermediate point after one of the horizontal roll stands in the train of roughing rolls and the mean value thereof is used as a reference width for calculating the width variation.

The present invention is essentially based on the principle heretofore explained. Generally, it is known that a plurality of skid-free areas exist in a single slab free from the furnace. According to this invention, if and when the actual width of a portion is greater than the reference width stated above even at the skid-free areas, such portion shall be subjected to an application of increased width reduction. While all what is given herein is particularly concerned with the case in which increase of width reduction of a material is provided during the rolling operation, it is needless to mention that it is necessary to decrease the amount of width reduction in case the width of the material is less than the reference width at a certain portion thereof.

In general, the amount of width variation at the longitudinal ends or at the leading end and/or the trailing end of a material to be rolled is greater than that at the longitudinal middle area thereof. It is, of course, possible to practice the method of the present invention at such portions—i.e. the leading and trailing ends of the material. Incidentally, it is not necessarily intended that the present invention will be used for control over all of the longitudinal area of the material, but it is essential to control width variation at least over the middle area out of the entire longitudinal area of such material.

In the practice of the present invention the width measurement of the material undergoing rolling operation through the train of roughing roll stands may be conducted at delivery side of any of the horizontal roll stands except for the first and last horizontal roll stands in the train.

Figure 3:
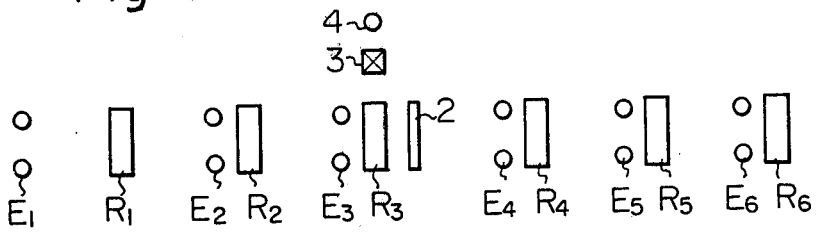
FIG. 3 is a schematic plan view showing a train of roughing roll stands used in practice of the present invention.
Figure 4:
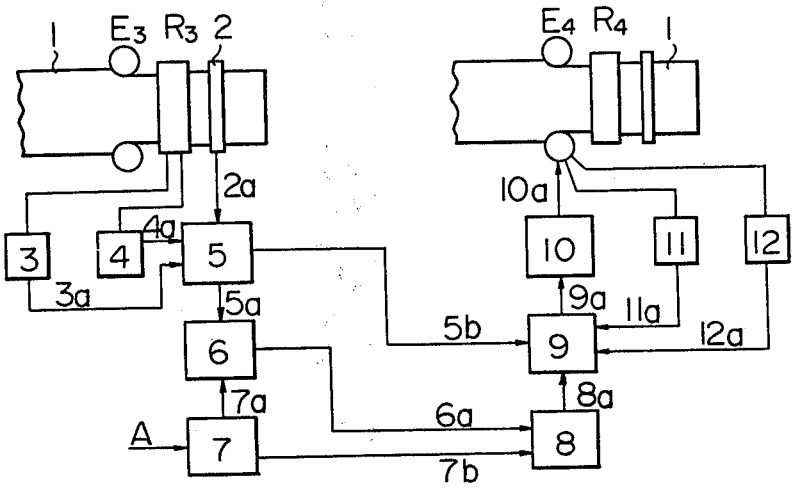
FIG. 4 is a block diagram showing the control section of the present invention.

The present invention will now be described by way of a preferred embodiment thereof in conjunction with FIGS. 3 and 4. As typically shown in FIG. 3, the train of roughing roll stands for use in the practice of the present invention comprises a plurality of vertical roll stands $E_i$ (i=1, 2, . . . 6) and a plurality of horizontal roll stands $R_i$ (i=1, 2, . . . 6) arranged in series and alternately one after another in such a manner that except for the first vertical roll stand $E_1$ and the first horizontal roll stand $R_1$, horizontal roll stands $R_i$ are all positioned immediately after corresponding vertical roll stands $E_i$, respectively. More particularly, in the present embodiment it is arranged such that width measurement is conducted at the delivery side of the third horizontal roll stand $R_3$, on the basis of the results of which measurement the fourth vertical roll stand $E_4$ is controlled with its degree of roll opening or roll gap. Hereinafter, these vertical and horizontal roll stands are referred to herein as "stand".

Upon detection of engagement of a material 1 to be rolled at the stand $R_3$ by means of a load cell 3 located in the stand $R_3$, a pulse generator 4 attached on the stand $R_3$ functions to measure the number of revolutions of the rolls from the moment of engagement of the material 1. On the other hand, a width gauge 2 disposed at the delivery side of the stand $R_3$ measures continuously the width of the material 1 at the delivery side thereof. Upon receipt of signals 2*a*, 3*a*, and 4*a* from such width gauge 2, load cell 3 and pulse generator 4, respectively, an operation and memory unit 5 function to recognize the longitudinal position of a point of width measurement on the material 1 and also operate amounts of width variation at respective points, and then the thus-obtained values of width variations are given in correspondence to the longitudinal position of the material 1, whereby a distribution of width variation values in the longitudinal direction of the material 1 is now operated and so stored.

On the other hand, a pass schedule operation unit 7 operates, upon the entry of such input signals representing a thickness and a width of a slab before being rolled by the train of roughing roll stands, a desired thickness and a desired width of a rolled bar at the delivery side of the train of roughing roll stand, as well as such rolling factors as a coefficient of mill rigidity of each stand and a maximum output of each mill drive motor, to attain a pass schedule for the entire roll train. When the results 7*a* of this operation and a signal 5*a* received from the unit 5 representing distribution of width variation are fed to an operation unit 6, the unit 6 operates the local coefficient $\gamma_S$ of width spread due to respective bulging. Upon entry of an output signal 6*a* of the operation unit 6 and an output 7*b* from the pass schedule operation unit 7 mentioned above to an operation unit 8, the unit 8 now operates based on the equation (10), etc., to obtain a desired amount of modified rolling width reduction that is required for reducing to zero the amount of width variation of the material 1 at the delivery side of the train of roughing roll stands, the amount of width variation due to the width spread being such as expected at the portions downstream of the width measurement when the modification of width reduction is not effected. Next, a roll opening control unit 9 disposed at the stand $E_4$ operates, upon receipt of an output 8*a* from the operation unit 8 and a signal 5*b* representing distribution of width variation from the operation and memory unit 5, to obtain the roll opening control value required for the modification of width reduction. This unit 9 then recognizes the current rolling position of the material 1 from the relationship with the longitudinal position thereof by way of signals 11*a* and 12*a* from the load cell 11 and the pulse generator 12, respectively of the stand $E_4$, and determining an amount of control required at that rolling position as a signal 9*a* and feeds the signal 9*a* to a screwdown unit 10. In accordance with such signal the unit 10 sends a screwdown signal 10*a* to the stand $E_4$ thereby controlling the roll opening at that stand.

Now, by way of comparative example, a practical rolling procedure according to the present invention is described and compared with the conventional procedure. According to a pass schedule as shown in Table 1, slabs having such dimensions as a thickness of 300 mm, a width of 1200 mm, and heated to temperature of 1200° C. were rolled in two different ways, i.e., the conventional way of rolling such that the degree of roll opening in each of the vertical roll stands is kept unchanged after the commencement of the rolling and the way employing the method according to the present invention.

TABLE 1

| | $E_1$ | $R_1$ | $E_2$ | $R_2$ | $E_3$ | $R_3$ | $E_4$ | $R_4$ | $E_5$ | $R_5$ | $E_6$ | $R_6$ |
|---|---|---|---|---|---|---|---|---|---|---|---|---|
| Amount of | | | | | | | | | | | | |

TABLE 1-continued

| | $E_1$ | $R_1$ | $E_2$ | $R_2$ | $E_3$ | $R_3$ | $E_4$ | $R_4$ | $E_5$ | $R_5$ | $E_6$ | $R_6$ |
|---|---|---|---|---|---|---|---|---|---|---|---|---|
| Width Reduction | 65 | | 50 | | 43 | | 35 | | 21 | | 0 | |
| Amount of Thickness Reduction (Draft) | | 54 | | 75 | | 70 | | 43 | | 18 | | 14 |

The measure value of width variation $\Delta W_3$ between a point which represents a typical skidded area and a point representing a typical skid-free area of the material at the delivery side of the stand $R_3$ was 5.2 mm. By applying the equation (6) above, the local coefficient $\gamma_S$ of width spread due to respective bulging was 0.77. In this example, the reference coefficient $\gamma$ of width spread due to bulging was 0.70 from the field data available.

Figure 5:
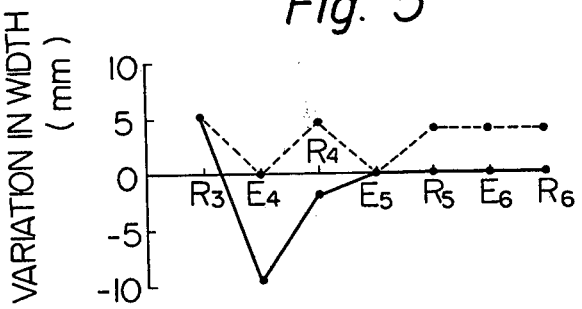
FIG. 5 is a graphic representation showing the calculated amounts of width variation at the delivery side of the roll stands wherein the broken line corresponds to the case in which no correction was effected for reducing variation in width and the solid line indicates the case in which the correction was applied according to the present invention.

By using the thus-obtained $\gamma_S$ value, the result of calculation on the amount of width variation between the point representing a typical skidded area and that for a typical skid-free area of the material at the delivery sides of the stands $E_4$, $E_5$, $R_4$ and $R_5$ is as shown in FIG. 5. In FIG. 5, a broken line shows the width change of the case where no modification in width reduction was practiced at the stand E (the conventional method), while a solid line showing that of the case where the modification in width reduction was practiced at the stand $E_4$ (according to the present invention).

In case that no modification in width reduction is effected, the calculated value of width variation at the delivery side of the train of roughing roll stands was 3.9 mm while the measured value was 3.7 mm. In contrast, when the modification in width reduction was practiced, the calculated value of width variation was of course zero, while the measured value was 0.8 mm.

According to the present invention, in order to attain substantially no width variation of the rolled bar at the delivery side of the train of roughing roll stands, it is noted that there should be provided a modification in width reduction such that the width of the material at the skidded area is made narrower than that at the skid-free area. In this case, the amount of increased width reduction $\Delta v_m$ turned out to be 9.7 mm, and the value $\Delta v_m^*$ to be applied for screwdown was 10.9 mm at the stand $E_4$.

While what has been described heretofore is based on the results of calculation and the measured values thereof provided with respect to the typical skidded and skid-free areas existing in the longitudinal area of the material to be rolled, in consideration that continuous variation in width exists at the respective positions of the material as stated above, there are presented, in FIGS. 6*a*, *b* and *c*, the results of filed measurement and calculation of such width variation existing over the longitudinal areas of the material. FIG. 6*a* shows the amount of width variation measured by the width gauge disposed at the delivery side of the stand $R_3$, while a broken line in FIG. 6*c* shows the measurement of width variation of the material processed by the conventional method at the delivery side of the train of roughing roll stands wherein no modification was effected at the stand $E_4$.

Figure 6:
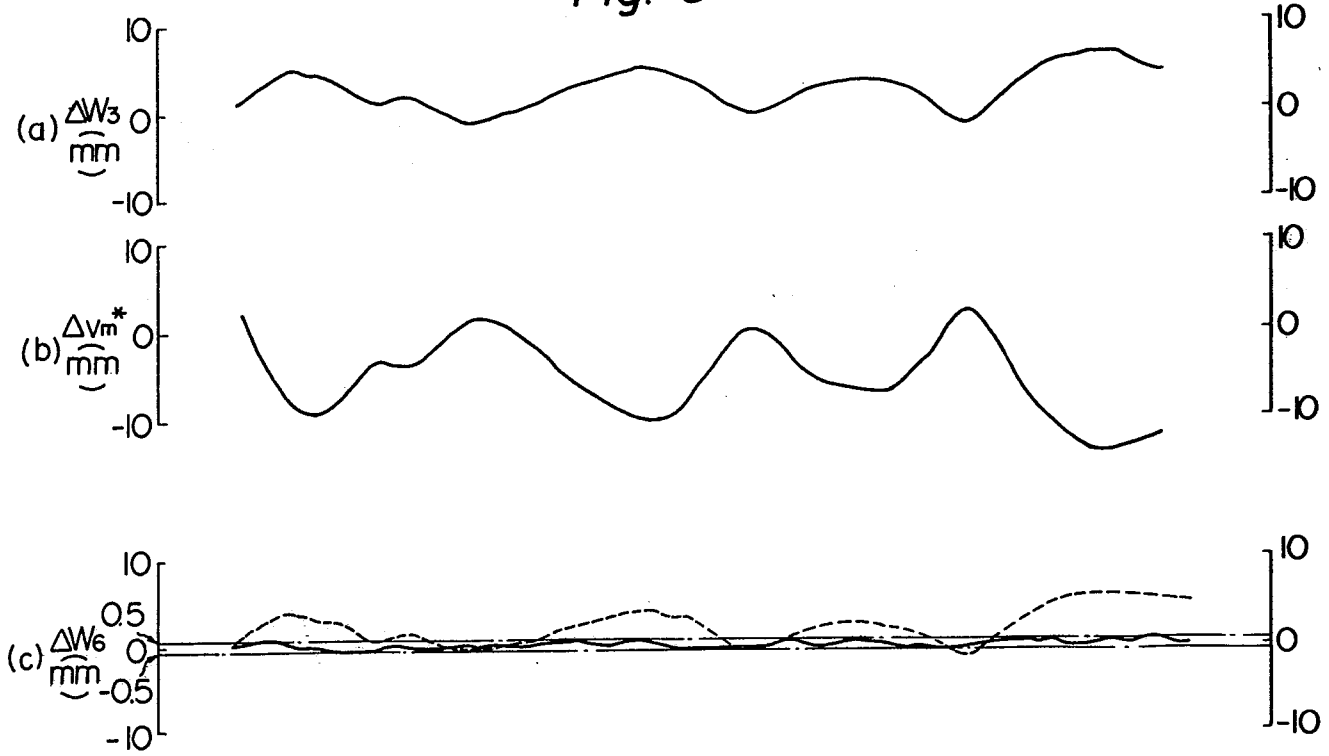
FIG. 6*a* is a graph showing a measured width variation over the entire middle area extending in the longitudinal direction of a material observed at the delivery side of the stand $R_5$.
FIG. 6*b* is a graph showing a correction amount of the roll opening at the stand $E_4$ over the entire middle area extending likewise in the longitudinal direction of the material.
FIG. 6*c* is a graph showing measured width variation over the same area at the delivery side of the least stand $R_6$ and wherein the broken line corresponds to the case in which no correction was effected for reducing variation in width and the solid line indicates the case in which the correction was applied accorcing to the present invention, among FIGS. 6*a*, 6*b* and 6*c*, the abscissa depicts the longitudinal position of the rolled bar, and the left hand ends of the graphs are for the leading end of the material or bar while the right hand ends of the graphs are for the trailing ends.

Next, according to the present invention, a modification in width reduction was effected at the stand $E_4$ as typically shown in FIG. 6*b*, and such modification could reduce the variation in width at the delivery side of the train of roughing roll stands to within the range of ±0.5 mm, i.e. within 1.0 mm variation, as shown by the solid line of FIG. 6*c*. The respective abscissas in FIG. 6 indicate the longitudinal direction of the material to be rolled. FIG. 6*c* is reduced in scale to allow for possible elongation in the longitudinal direction of the material downstream of the stand $E_4$ so that the longitudinal position thereof may correspond to those shown in FIGS. 6*a* and 6*b*.

According to the results of the width controlling experiments by way of the method according to the present invention by changing the slab dimensions, the heating conditions and the rolling schedule in many ways, it was eventually acknowledged that such amount of width variation under the effect of skid marks as appeared in the material to be rolled at the delivery side of the train of roughing roll stands could be kept assuredly at the low level of 1.0 mm or less in all cases.

As is readily appreciable from the detailed description hereinabove, it is noted that the present invention provides a markedly advantageous method of controlling or minimizing width variation of rolled bar.

We claim:

1. A method for controlling the width of material in hot strip rolling through a train of roughing roll stands in which a plurality of vertical roll stands and a plurality of horizontal roll stands are arranged in series and alternately one after another, said method comprising the steps of (1) measuring the width of a material to be rolled over at least the entire middle area out of the entire longitudinal area thereof at the delivery side of any one of the horizontal roll stands disposed intermediately in said train of roughing roll stands; (2) deriving values of the variations in width of the respective portions in the longitudinal direction based on the values of the width measured during said measuring step; (3) calculating a reference coefficient of width spread based on empirically derived data reflective of the rolling conditions of said horizontal and vertical roll stands; (4) determining respective local coefficients of width spread due to bulging at the lateral marginal portions of the material to be rolled for at least all the middle area out of the entire longitudinal area of the material to be rolled based on (a) said values of the variation in width, (b) the degree of width reduction at each of the vertical roll stands upstream of the measuring point and (c) said reference coefficient of width spread; (5) after step (4), calculating the required amount of modification to be applied for screwdown over at least the entire middle area of said material in order to reduce to zero the expected variation in width in the portions of material downstream of the places of the measurement based on the local coefficient of width spread due to respective bulgings, (b) the amount of width reduction at each of the vertical roll stands located downstream of the vertical roll stand where the opening thereof is to be controlled, (c) said reference coefficient of width spread due to bulging and (d) said values of width variation at the respective portions; and (6) controlling the opening of at least one of the vertical roll stands located downstream of said place of measurement so that said required amount of modification for screwdown is applied over at least the entire middle area out of the entire area of said material to be rolled.

* * * * *